United States Patent [19]

Croley

[11] 4,240,565

[45] Dec. 23, 1980

[54] DRUM-LIKE FIBERBOARD CONTAINER FOR BULK MATERIAL WITH FUNNEL-LIKE DISPENSING BOTTOM

[75] Inventor: Thomas E. Croley, Worthington, Ohio

[73] Assignee: Willamette Industries, Inc., Portland, Oreg.

[21] Appl. No.: 81,767

[22] Filed: Oct. 4, 1979

[51] Int. Cl.[3] ..... B65D 19/06

[52] U.S. Cl. ..... 222/105; 222/183; 222/460; 222/564

[58] Field of Search ..... 222/460, 461, 462, 564, 222/105, 183; 229/17 B, 23, 23 BT

[56] References Cited

U.S. PATENT DOCUMENTS

| | | | |
|---|---|---|---|
| 3,172,570 | 3/1965 | Lipschutz | 222/105 |
| 3,563,448 | 2/1971 | Croley | 229/23 |
| 4,042,164 | 8/1977 | Croley | 229/23 BT |
| 4,120,420 | 10/1978 | Dirksing | 222/460 X |

FOREIGN PATENT DOCUMENTS

| | | | |
|---|---|---|---|
| 1214017 | 11/1970 | United Kingdom | 222/462 |

*Primary Examiner*—Allen N. Knowles
*Attorney, Agent, or Firm*—William V. Miller

[57] ABSTRACT

A drum-like container of fiberboard or similar material supplied in flat knocked-down form and adapted to be set up to serve as a shipping and dispensing container for bulk material. It is provided with a funnel-like dispensing bottom made up of fiberboard segmental wedge-shaped bottom insert sections which are supplied in flat knocked-down form and are adapted to be first set up and then positioned on the bottom of the container in a funnel-like arrangement with a central dispensing opening.

10 Claims, 9 Drawing Figures

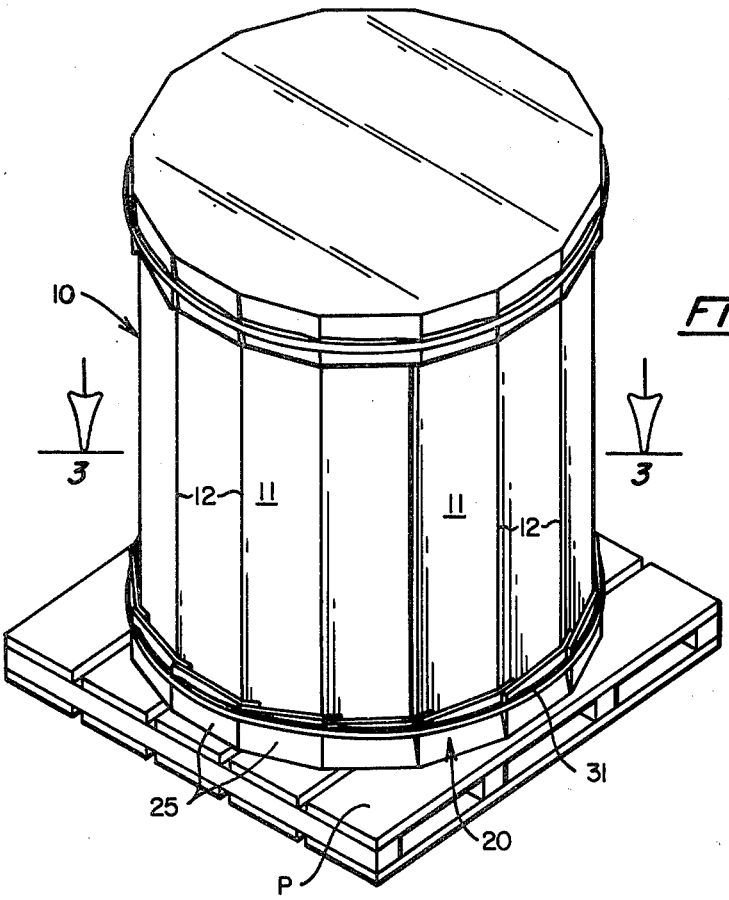
FIG. 1
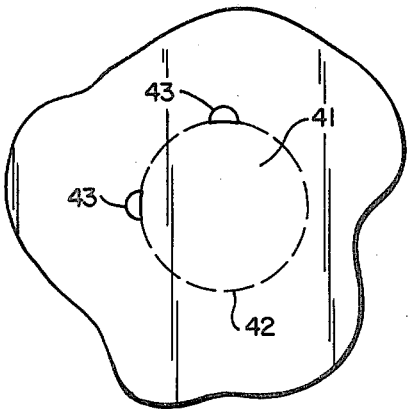
FIG. 3A
FIG. 2
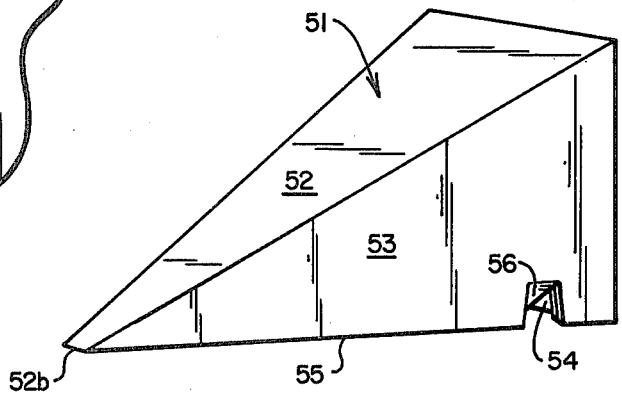

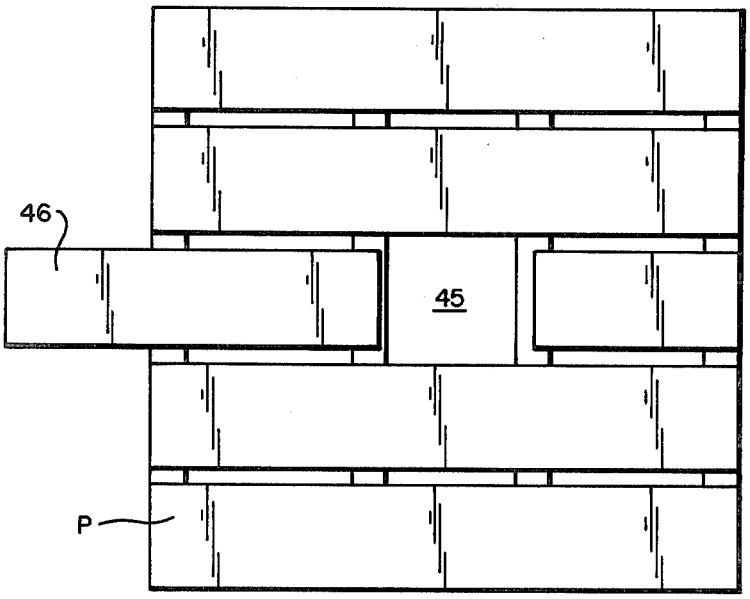
FIG. 7
FIG. 8
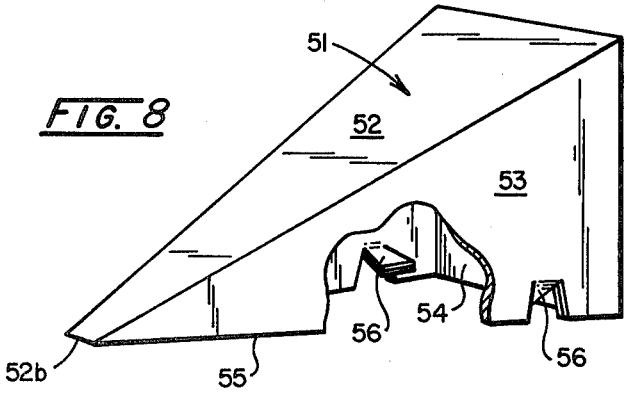

DRUM-LIKE FIBERBOARD CONTAINER FOR BULK MATERIAL WITH FUNNEL-LIKE DISPENSING BOTTOM

BACKGROUND AND PURPOSE OF THE INVENTION

This invention relates to a fiberboard container assembly of the type disclosed in my prior U.S. Pat. No. 3,563,448 and 4,042,164. It deals specifically with a bottom structure for a container of that type which will facilitate dispensing of various substances therefrom, especially dry material in bulk which otherwise tends to bridge in corners of the bottom, even though a dispensing opening is provided in the bottom.

SUMMARY OF THE INVENTION

The patents referred to above show a flat bottom without a dispensing opening. The present invention provides a central dispensing opening in that bottom with segmental wedge-shaped inserts positioned around the opening in tight frictional engagement and having inclined surfaces for directing material towards the central opening. The result is what, in effect, is a false bottom of funnel-like form which will effectively direct the contents of the container through the dispensing opening when it is unsealed. The segmental inserts are also of fiberboard or similar material and are supplied in flat knocked-down form.

BRIEF DESCRIPTION OF THE DRAWINGS

The best mode contemplated in carrying out this invention is illustrated in the accompanying drawings in which:

FIG. 1 is a perspective view of the container assembly to which this invention is applied.

FIG. 2 is a perspective view of one of the segmental bottom inserts.

FIG. 3A is a plan view showing a displaceable opening-forming part in the flat bottom disc.

FIG. 7 is a plan view of a pallet which may be used as a support for the container assembly.

FIG. 8 is a perspective view, similar to FIG. 2 but cut away to show the interior of the segmental insert section.

DETAILED DESCRIPTION OF THE INVENTION

Figure 3:
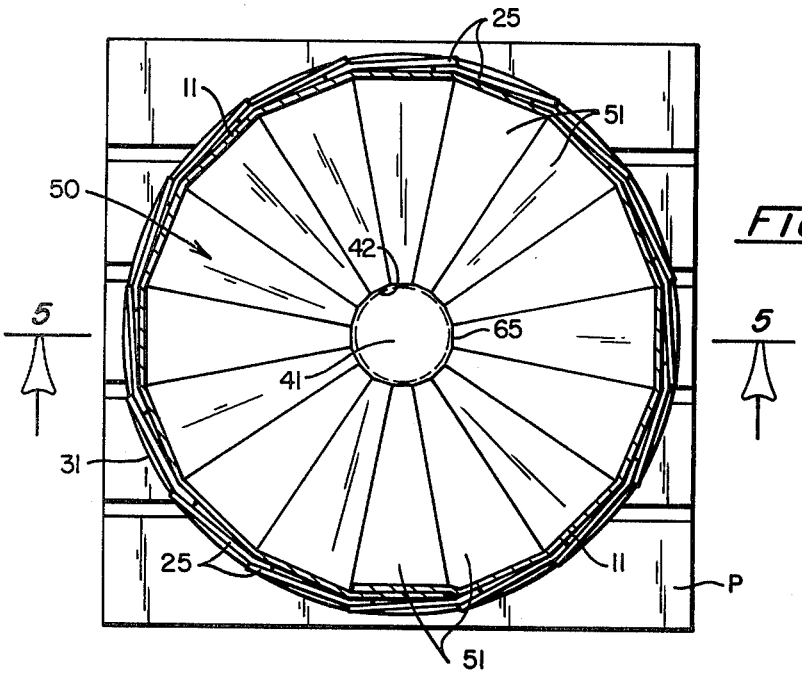
FIG. 3 is a horizontal sectional view taken along line 3—3 of FIG. 1.

With reference to the drawings and particularly to FIG. 1, there is shown generally a fiberboard container assembly of the type described in my U.S. Pat. Nos. 3,563,448 and 4,042,164 and in which the present invention is incorporated. As described in said patents, the container assembly includes a drum-like container body 10 of multi-sided polygonal form which is composed of a series of vertical panels 11 hinged together at 12. The body is supplied in flat knocked-down form and is set up on a tray-like bottom closure element 20 which includes a flat polygonal disc-like bottom 21 and hinged attaching flanges 25. This bottom closure is also formed of fiberboard or the like and the flanges 25 are turned upwardly so that they overlap the panels 11 and are secured in that position such as by a retaining band 31. The flanges 25 are arranged similar to panels 11 and in corresponding number to properly overlap them and cooperate therewith. The lower ends of the panels 11 are provided with inwardly-turned flanges 14 which rest on the flat bottom 21 to which they are secured and both these members may be (FIG. 5) secured to a pallet, indicated generally at P, by fasteners in the form of nails or staples which are passed downwardly through the flanges 14 and bottom 21 into the pallet.

In order to dispense material through the bottom of the container, a central opening can be provided in the center of the flat disc-like bottom 21 by means of a downwardly-displaceable central disc 41. Disc 41 (FIG. 3A) is formed by a circular perforation 42 with at least two semi-circular cuts at angularly spaced positions to provide pull-out tabs 43. Disc 41 is normally in the plane of flat bottom 21 but can be displaced downwardly by engaging a tool with the tabs 43 to provide the central bottom opening 44.

Figure 5:
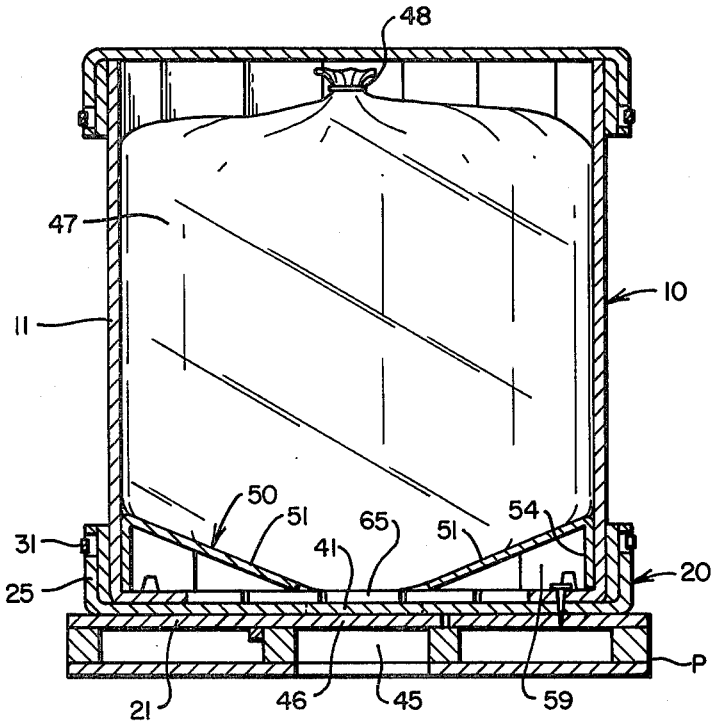
FIG. 5 is a vertical sectional view taken along line 5—5, of FIG. 3 showing the container filled and the bottom sealed.
Figure 6:
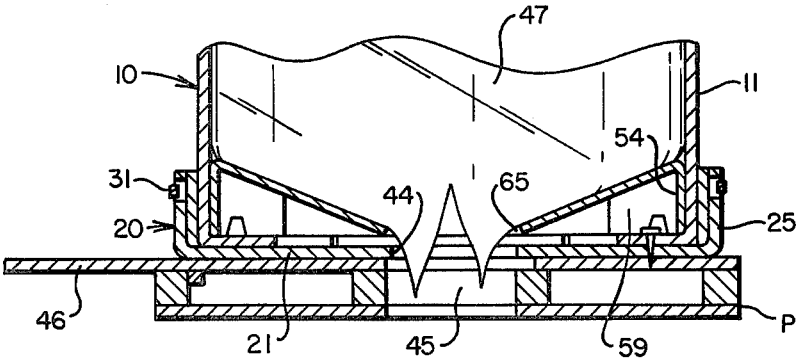
FIG. 6 is a similar but partial sectional view showing the bottom unsealed for dispensing.

To cooperate with this opening 44 the pallet P is provided with a central opening 45, as shown in FIGS. 5, 6 and 7, but which is normally covered by the slidable slat 46, as shown in FIG. 5. In closed inner position the slat 46 will be beneath the downwardly-displaceable opening-forming disc 41.

If the container assembly is to receive certain materials, such as dry granular materials, liquids or semi-liquids, it may be desirable to provide a liner in the form of a bag 47 which will be closed at its bottom and open at its upper end. This bag, as will later appear, will rest on the bottom of the container and will preferably be filled from the top while in that position, being held closed or sealed after filling by any suitable fastening means 48 at the top.

To ensure that all the contents of the container will flow therefrom through the central bottom opening 44 formed by displacing disc 41, there is provided, according to this invention, a false bottom of funnel-like form indicated generally by the numeral 50. This bottom is made up of individual wedge-shaped segmental insert sections 51 which are set up from a flat blank and then inserted radially and wedged together tightly in the container body 10 and rested on the flanges 14 and flat bottom 21 around the opening-forming disc 41.

Each segmental insert section 51, as shown in FIGS. 2 and 8, comprises an inclined-plane, material-directing wall 52 supported in its inclined position by a pair of vertical support walls 53 and an outer vertical wall 54. The vertical walls 53 substantially converge at the inner end of the insert but it will be noted that wall 52 is slightly blunt at **52*b*. The wall 54 at the outer end of the insert is of substantial height and of a width corresponding to that of one of the panels 11. All the vertical walls have lower support edges 55 in a common horizontal plane. A locking arrangement is provided at 56 to hold the segmental structure together after it is set up from the blank shown in FIG. 4. It will be noted the insert is wedge-shaped transversely, or in horizontal cross-section, due to the form of upper wall 52, and that it is also wedge-shaped longitudinally or in vertical cross-section due to the shape of the vertical support walls 53**.

Figure 4:
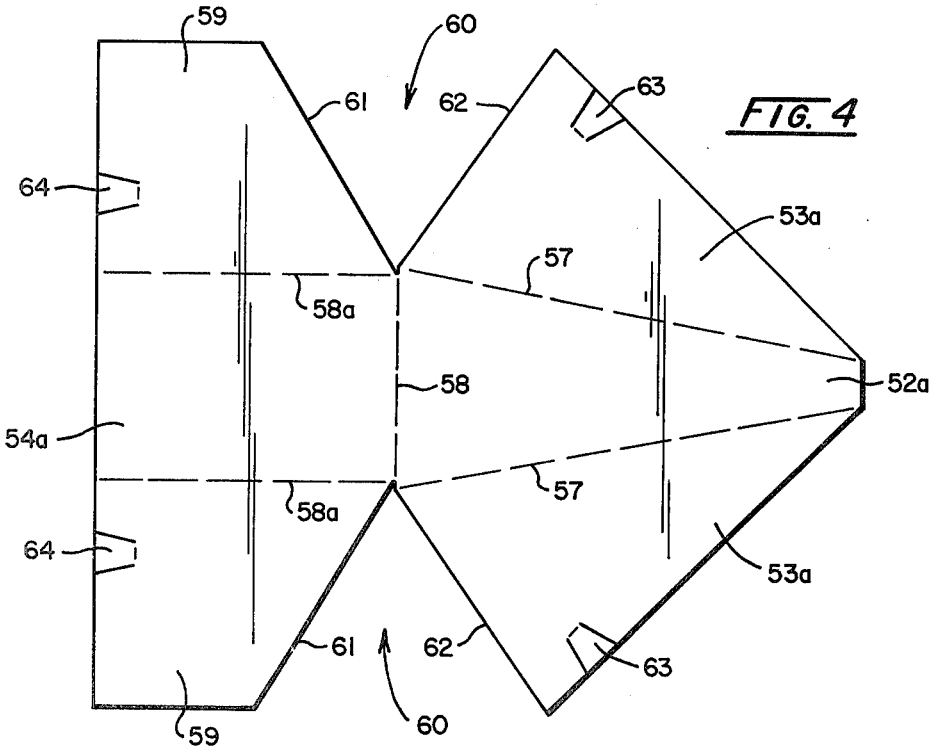
FIG. 4 is a plan view of the blank used in forming a bottom segmental insert.

The blank shown in FIG. 4 is a flat blank of fiberboard cut and scored, as indicated, with little waste to provide the central blunted triangular inclined-wall-forming panel 52*a*, hinged at both of its side edges, at score lines 57, to a pair of the triangular vertical-wall forming panels 53*a*. At its wide end, the panel 52*a* is hinged at score line 58 to the end-vertical-wall-forming panel 54*a* of rectangular form which, in turn, is hinged at the score lines 58*a* to a pair of locking flaps 59. Large V-notches 60 are formed at opposed sides of the blank to provide the angular edges 61 on the panels 59 in proper diverging relationship to the edges 62 of the panels 53*a*. The locking means 56, previously mentioned, is formed by displaceable hinged locking tabs 63 formed in the outer edges of the respective panels 53*a*, adjacent edges 62, and similar tabs 64 formed in the outer straight edges of the respective panels 61, adjacent the hinge score lines 58*a*.

The blank is folded at score lines 57 from its flat condition of FIG. 4 so that the panels 53*a* are vertical. Then the locking flaps 59 are folded in the same direction, at score lines 58*a*, relative to the panel 54*a* and simultaneously, the panel 54*a* is folded, at score line 58, to move the flaps inwardly within and into overlapping relationship with the vertical panels 53*a*. As the wall panel 54*a* reaches vertical position, the locking tabs 64 of flaps 59 will align with the locking tabs 63 of the panels 53*a*. It will be noted from FIGS. 4 and 8 that when each of the locking flaps 59 is fully inserted, its angular edge will lie beneath and in contact with the lower surface of the inclined wall 52 and that the straight edge of the flap will be lowermost and will align with the straight lower edge of the adjacent vertical wall 53. To secure these overlapping panels together, it is merely necessary to push inwardly to displace the overlapping tabs 63 and 64, as shown in FIGS. 2 and 8.

Assuming the body 10 of the container is assembled on the bottom closure 20, the false bottom 50 may be formed by inserting the individual segments 51 in a number corresponding to the number of side panels 11. In this example it is sixteen, but the container body may have a different number of side panels 11. The inserted wedge-shaped sections will tightly engage adjacent sections when the last is inserted. The segments 51 will be of proper length so that when they are positioned radially with their outer vertical support walls 54 in flat contact with the inner surfaces of the side panels 11 and their lower edges resting on flat bottom 21, there will be a central opening 65 formed at the inner ends of the segments which will be over the weakened center of the flat bottom 21 provided by the downwardly displaceable opening-forming disc 41. The opening 65 will be of polygonal cross-section similar to that of the horizontal cross-section of the container body 10 but will be almost circular. The result will be a false bottom which tapers downwardly towards the central opening to feed the material towards that opening.

When the bag 47 is provided and filled, it rests on the false bottom 50 and will seal the opening 65, as shown in FIG. 5. To dispense the contents of the bag, the disc 41 will be pulled downwardly, out of position to form opening 44 after the slidable slat 46 of the pallet P is moved to expose that disc. Then, the bottom of the bag 47 is ruptured, as indicated in FIG. 6, to permit the material to discharge through the aligning false bottom opening 65, the opening 44 in flat bottom 21 provided by displacement of the disc 41, and the opening 45 in the pallet P.

It will be apparent from the above, that this invention provides a bottom structure for a drum-like polygonal container of the type indicated which will ensure the effective discharge of all of the container contents. The bottom structure is formed of separate strong wedge-shaped segmental insert sections which are provided in flat-knocked-down condition but can be readily set up quickly and inserted within the container to provide a funnel-like material directing and dispensing arrangement. The strength of the bottom is obtained by means of the plurality of separate segmental sections, each having depending supporting walls from the upper material-directing wall.

Having described this invention what is claimed is:

1. A container assembly comprising a tubular body of fiberboard or the like with a bottom structure at its lower end and with side-wall forming panels extending upwardly at the periphery thereof, said bottom structure including support means secured to said side-wall panels; said bottom structure also including a plurality of separate segmental insert sections forming a funnel-like dispensing bottom with a central dispensing opening, each of said separate insert sections comprising an upper material-directing wall having a pair of depending wedge-shaped supporting walls each with a wider end outwardly at one of said side wall panels and extending inwardly to a point spaced from the center of the bottom structure at the dispensing opening, said support walls having lower edges supported by said support means of the bottom to support said material-directing wall so that it inclines downwardly towards said dispensing opening.

2. A container assembly according to claim 1 in which the body is of multi-sided polygonal drum-like form and includes a preselected number of panels hinged together to form the side walls, said segmental inserts being identical with each other and provided in the same number as said panels and each having an outer support wall depending from said material-directing upper wall and a lower edge supported by the support means of the bottom with the outer wall of each insert being in flat contact with its corresponding side-wall-forming panel, said material-directing wall being of substantially triangular form with a wide end and a narrow end inwardly to thus provide an insert which is substantially wedge-shaped both vertically and horizontally.

3. A container assembly according to claim 2 in which a flexible bag adapted to be filled is provided within said container body resting on said inserts, said bag having a bottom which can be ruptured through said opening.

4. A container assembly according to claim 2 in which the bottom structure support means includes a tray-like closure of fiberboard or the like having a flat bottom with a polygonal periphery having upstanding flanges hinged thereto which correspond in number and arrangement to said panels and extend upwardly over corresponding panels to which they are secured, said flat bottom having a displaceable portion located directly below said opening to form a dispensing opening therein, said inserts resting on said flat bottom to provide said opening between their inner ends over said displaceable portion.

5. A container assembly according to claim 4 in which a pallet is provided on which said flat bottom rests, said pallet having a support part normally supporting said displaceable bottom portion but movable away from that supporting relationship.

6. A container assembly according to claim 4 in which the container body, tray-like container bottom, and each of the inserts is supplied in flat knocked-down condition and each is set up as indicated.

7. A container assembly according to claim 6 in which each insert comprises the top material-directing wall of substantially triangular form having a wide outer end and a slightly blunt inner end supported in inclined position by the depending support side walls hinged to the side edges thereof and resting on said flat bottom and by a depending outer wall hinged to the wide outer end thereof and resting on said flat bottom and which has its outer flat surface engaging a flat inner surface of the corresponding panel of the container body.

8. A container assembly according to claim 7 in which the depending outer wall has locking flap members hinged to each vertical edge thereof and extending inwardly into overlapping relationship with the inner surfaces of the corresponding depending wall members, and aligning inwardly displaceable tabs in the overlapping locking flaps and vertical wall members for locking them together.

9. A container assembly according to claim 4 in which said displaceable portion is formed in the flat bottom by a circular perforation at the center thereof.

10. A container assembly according to claim 9 in which slits are extended outwardly from the circular perforation to provide pull-out tabs.

* * * * *